US005609341A

United States Patent [19]

Chuang

[11] Patent Number: 5,609,341

[45] Date of Patent: Mar. 11, 1997

[54] SIGHT-DESIGNED FISHING GAME TOY

[76] Inventor: Chuan-Tien Chuang, No. 40, Lane 174, Da-Shing Street, Tainan, Taiwan

[21] Appl. No.: 614,002

[22] Filed: Mar. 11, 1996

[51] Int. Cl.[6] ..... A63F 9/00

[52] U.S. Cl. ..... 273/448; 40/414; 446/352

[58] Field of Search ..... 273/448, 447, 273/140; 40/411, 412, 414, 426; 446/330, 332, 352, 357, 354, 267

[56] References Cited

U.S. PATENT DOCUMENTS

| | | | |
|---|---|---|---|
| 3,975,845 | 8/1976 | Mellard | 40/414 |
| 4,324,059 | 4/1982 | Baum | 40/414 X |
| 4,603,860 | 8/1986 | Wey | 273/448 |
| 4,790,532 | 12/1988 | Chen | 273/140 X |
| 4,838,553 | 6/1989 | Chuan-Tien | 273/448 X |
| 5,009,418 | 4/1991 | Chuan-Tien | 273/140 X |
| 5,050,876 | 9/1991 | Chuang | 40/426 X |
| 5,092,065 | 3/1992 | Teng | 40/411 X |

*Primary Examiner*—Paul E. Shapiro
*Attorney, Agent, or Firm*—Bacon & Thomas

[57] ABSTRACT

A sight-designed fishing game toy including a base and a transmission mechanism disposed therein. A sight tower preferably made of transparent material is disposed on upper surface of the base. Various kinds of sight articles are disposed in the sight tower. A chamber is connected on top face of the sight tower for placing a rotary disk therein. Multiple fish dolls are disposed on the rotary disk. A hollow transmission column preferably made of transparent material has a bottom end drivingly connected with the transmission mechanism in the base. A connecting ring is disposed on the top end of the transmission column, whereby a central shaft of the rotary disk is passed through the chamber to drivingly connect with the transmission column.

8 Claims, 3 Drawing Sheets

SIGHT-DESIGNED FISHING GAME TOY

BACKGROUND OF THE INVENTION

The present invention relates to a sight-designed fishing game toy in which a funny sight relevant to the fishing game is disposed to create an entertaining effect.

A conventional rising game toy includes a rotary disk formed with multiple recesses in which various fish dolls are disposed. When the rotary disk is rotated, the fish dolls open their mouths to expose the metal stems therein. At this time, a fishing rod having a certain length of string and a small magnet disposed at the end of the string can be extended into the mouths of the fish dolls so as to fish the fish dolls from the recesses by means of the magnetic attraction. During the fishing game, the fish dolls respectively open their mouths along with the rotation of the rotary disk so as to create a funny and live entertaining effect. The magnet of the string of the fishing rod must attract the metal stems in the instant of opening of the mouths of the fish dolls so as to fish the fish dolls. Otherwise, the mouths of the fish dolls will close again to prevent the fish dolls from being fished.

The above fishing game toy is very popular and attractive, especially to children. However, in most of the existing fishing game toys, including single disk and multiple disk types, the rotary disk on which the fish dolls are placed is directly disposed on a base without any sight design. Therefore, such fishing game toys cannot provide great entertaining effect and attractive appearance for the player.

SUMMARY OF THE INVENTION

It is therefore a primary object of the present invention to provide a sight-designed fishing game toy including a base and a transmission mechanism disposed therein. A sight tower preferably made of transparent material is disposed on upper surface of the base. A transmission column is disposed in the sight tower for transmitting power from the transmission mechanism to the fish doll rotary disk so as to create more funny effect and appearance.

It is a further object of the present invention to provide the above sight-designed fishing game toy in which various kinds of creature dolls are disposed in the sight tower, which are moved along with the transmission mechanism so as to create live entertaining effect.

The present invention can be best understood through the following description and accompanying drawing, wherein:

DETAILED DESCRIPTION OF THE PREFERRED EMBODIMENT

Figure 1:
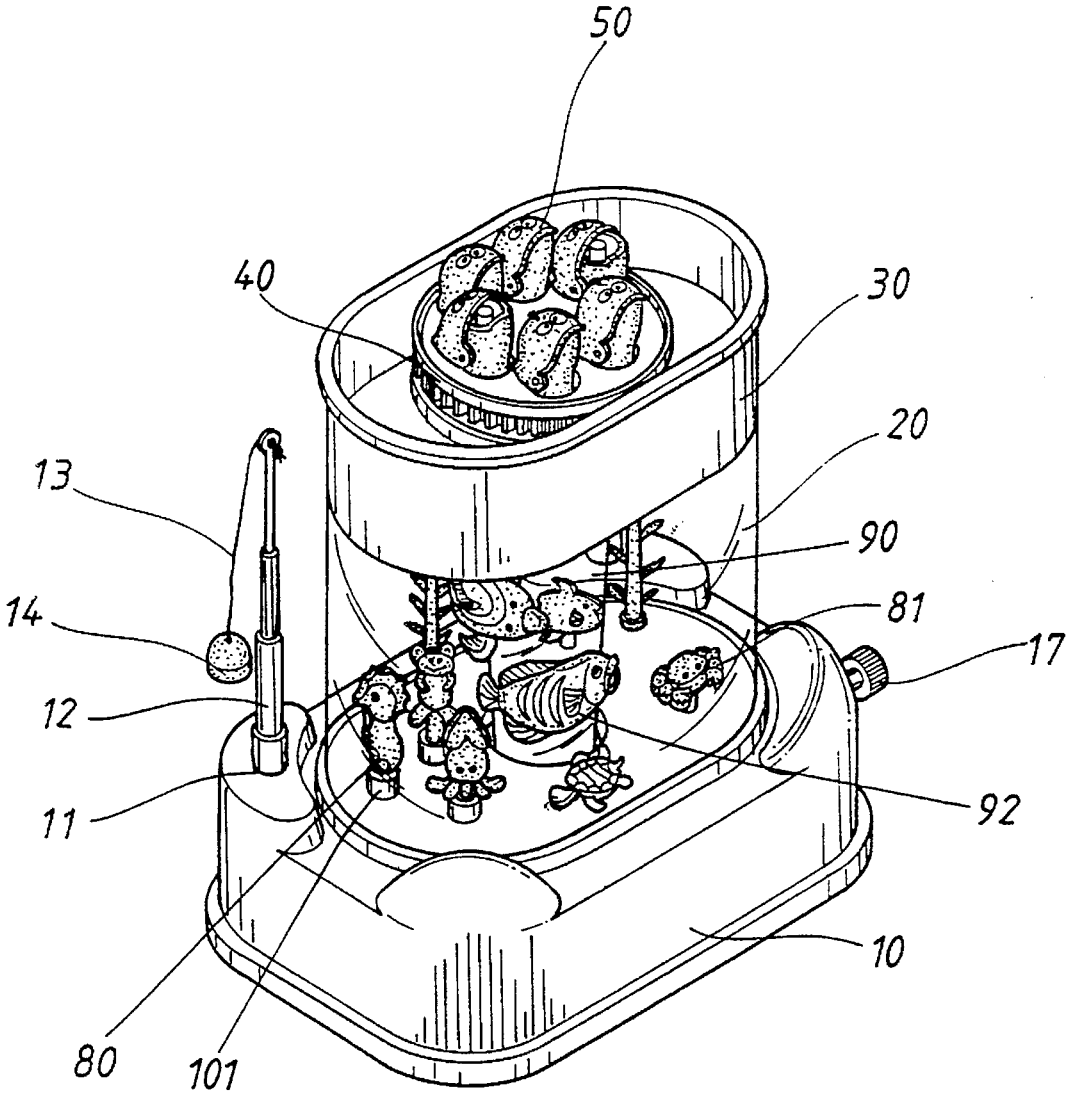
FIG. 1 is a perspective assembled view of the present invention.

Please refer to FIG. 1. The present invention includes a base 10 and a transmission mechanism disposed therein. A sight tower 20 preferably made of transparent material is disposed on the surface of the base 10. The sight tower 20 is slightly smaller than the surface area of the base and has a predetermined height. A chamber 30 is connected on the surface of the sight tower 20 for placing a rotary disk 40 therein. Multiple fish dolls 50 having upward facing mouths are disposed on the rotary disk 40. An insertion hole 11 is formed on the surface of the base 10 beside the sight tower 20 for a fishing rod 12 to insert therein. The fishing rod 12 has a certain length of string 13 and a small magnet 14 disposed at the end of the string 13.

Figure 2:
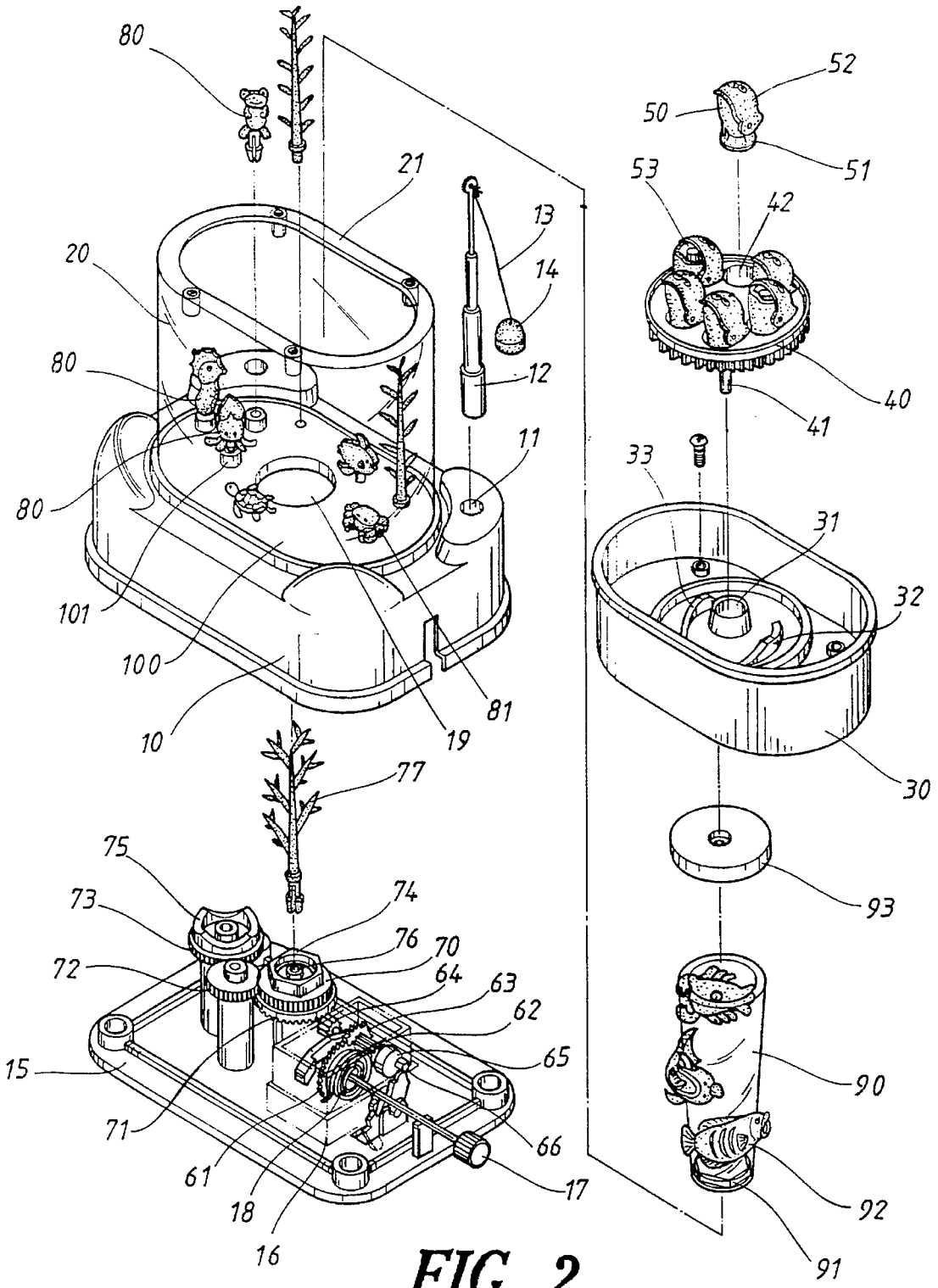
FIG. 2 is a perspective exploded view of the present invention.

Please refer to FIG. 2. A bottom board 15 is assembled with the bottom of the base 10. A gear room 16 is disposed on the bottom board 15. A coil spring 18 is disposed in the gear room 16 and tightened by an outward extending rotary switch 17 to resiliently drive the gears in the gear room. The coil spring 18 is coaxially drivingly engaged with an end gear 61 which is engaged with a first and a second gear sets 62, 63. The shafts of the gear sets 62, 63 serve to transmit power to a third gear 64 on left side of the gear room 16 and a rotary wheel 65 on the opposite side of the gear room. An eccentrical rod 66 is disposed on the outer surface of the rotary wheel 65.

The third gear 64 drives lower peripheral teeth 71 of an adjacent driving gear 70 which in turn drives an intermediate gear 72 drivingly engaged with a driven gear 73. An angled connecting face 74 is disposed on the upper surface of the driving gear 70 and a locating stake of the gear 70 is formed with an insertion hole 76 for a sight tree 77 to insert therein. The driven gear 73 is disposed with a concave/convex ring 75.

Figure 3:
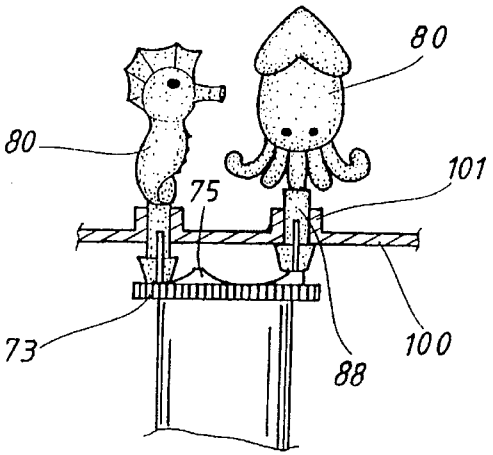
FIG. 3 shows the connection between the movable creature dolls in the sight tower and the driving gear of the present invention.

The upper surface 100 of the base 10 is formed with a central hole 19 and implanted with various kinds of deep sea creature dolls 80, 81, wherein the creature dolls 81 are directly fixedly inserted through the insertion holes of the upper surface, while the dolls 80 near the driven gear 73 have downward extending posts 88 passing through sockets 101 as shown in FIG. 3. The bottom ends of the downward extending posts 88 abut against the concave/convex ring 75 of the driven gear 73 so that when the driven gear 73 is rotated, the dolls 80 are moved up and down.

A hollow transmission column 90 preferably made of transparent material has a bottom end passing through the central hole 19 of the base. The bottom end of the transmission column 90 is formed with an angled inner hole 91 fitted with the angled connecting face 74 of the driving gear 70. Various kinds of deep sea creature dolls 92 are attached to outer peripheral surface of the transmission column 90. The top end of the transmission column is fitted with a connecting ring 93. The central shaft 41 of the rotary disk 40 passes through the central hole 31 of the chamber 30 to drivingly connect with the connecting ring 93.

The bottom of the transparent sight tower 20 is engaged with the upper surface of the base 10 and the top face of the sight tower is formed with a flange 21 abutting against and assembled with the bottom face of the chamber 30. In the chamber 30 are disposed radial high and low projecting strips 32, 33, whereby the bottoms 51 of the fish dolls 50 can pass through the holes 42 of the rotary disk to depress or release the high and low projecting strips 32, 33 so as to open or close the caps 52 of the fish dolls 50 and expose or cover the iron stems in the mouths thereof for the fishing game.

After the rotary switch 17 is tightened, the power is transmitted by the gear room 16 to the driving gear 70, intermediate gear 72 and the driven gear 73, whereby the driving gear 70 drives the transparent transmission column 90 and the rotary disk 40 on the top thereof. Accordingly, the fish dolls 50 are continuously rotated along with the rotary disk and the transmission column 90 is also rotated. Simultaneously, the concave/convex ring 75 of the driven gear 73 drives the movable creature dolls to move up and down.

Figure 4:
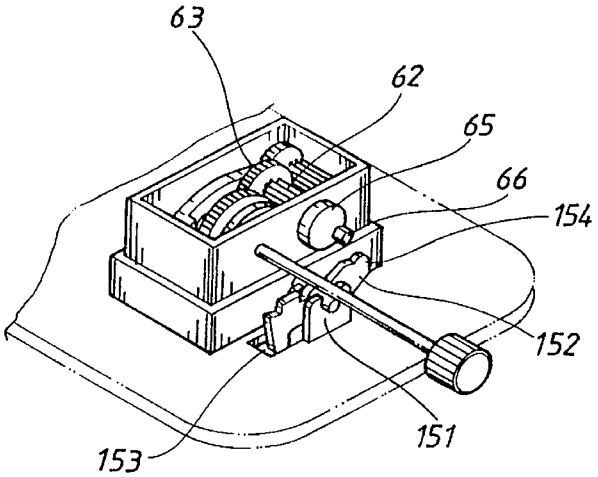
FIG. 4 is a perspective enlarged view of the gear room in the base and the rotary switch of the present invention.
Figure 5:
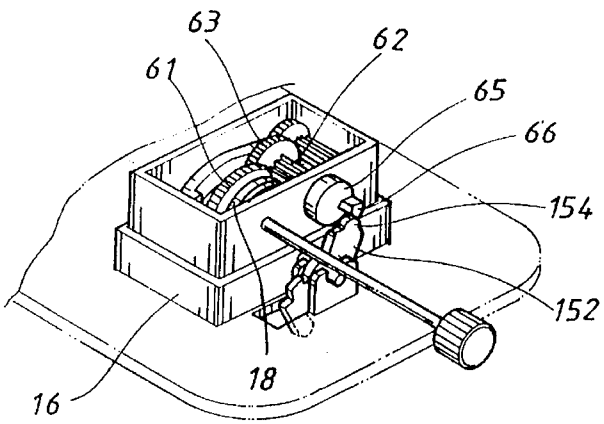
FIG. 5 is a view according to FIG. 4, showing that the transmission mechanism is stopped by the swinging plate of the present invention.

In order to instantaneously stop the operation of the entire fishing game toy, as shown in FIG. 4, a rack 151 is disposed on the base board 15 and a swinging plate 152 is pivotally supported on the rack 151 near the center. One end of the swinging plate 152 faces downward toward a slot 153 of the base board. When the entire toy is placed on a plane surface, the stopper end 154 of the swinging plate is positioned under the eccentrical rod 66 of the rotary wheel 65 without affecting the normal operation. In the case that the power (the resilient restoring force of the coil spring ) is not exhausted and it is desired to stop the game, the toy can be lifted, making the swinging plate 15 rotate about the pivot shaft, whereby the stopper end 154 thereof moves upward to stop the eccentrical rod 66. At this time, the operation of the entire toy immediately stops.

When the rotary disk is activated, the multiple fish dolls on the top face thereof serve to be fished in the fishing game. In addition, in the transparent sight tower are disposed cooperative deep sea sight and creature dolls which are rotated along with the transmission column and moved up and down along with the transmission mechanism. Therefore, a more funny and live entertaining effect is created in the fishing game.

It is to be understood that the above description and drawings are only used for illustrating one embodiment of the present invention, not intended to limit the scope thereof. Any variation and derivation from the above description and drawings should be included in the scope of the present invention.

What is claimed is:

1. A sight-designed fishing game toy comprising a base and a transmission mechanism disposed therein, a sight tower of transparent material being disposed on upper surface of the base, various kinds of sight articles being disposed in the sight tower, a chamber being connected on top face of the sight tower and having a rotary disk therein, multiple fish dolls being disposed on the rotary disk, a hollow transmission column having a bottom end drivingly connected with the transmission mechanism in the base, a connecting ring being disposed on the transmission column, and a central shaft depending from the rotary disk through the bottom of the chamber and drivingly connected with the transmission column.

2. A fishing game toy as claimed in claim 1, wherein the sight tower is slightly smaller than the surface area of the base and an insertion hole is formed on the surface of the base beside the sight tower for a fishing rod to insert therein, the top face of the sight tower being formed with a flange abutting against and assembled with the bottom of the chamber.

3. A fishing game toy as claimed in claim 1, wherein sight articles are attached to outer peripheral surface of the transmission column.

4. A fishing game toy as claimed in claim 1, wherein the transmission mechanism includes a gear room transmitting power to a driving gear fitted with the bottom of the transmission column and an intermediate gear drivingly engaged with the driving gear to transmit power to a driven gear for driving the sight articles in the sight tower.

5. A fishing game toy as claimed in claim 4, wherein a concave/convex ring is disposed on upper end of the driven gear, and the sight articles in the sight tower have depending spanks passing through the surface of the base to drivingly engage with the concave/convex ring.

6. A fishing game toy as claimed in claim 1, wherein the sight articles in the sight tower are directly fixedly inserted in the holes of the surface of the base.

7. A fishing game toy as claimed in claim 1, wherein the sight articles in the sight tower are movably inserted in sockets of the surface of the base.

8. A fishing game toy as claimed in claim 1, wherein the gear room is drivingly engaged with a rotary wheel exposed outside the gear room, an eccentrical rod being disposed on outer surface of the rotary wheel, a swinging plate being pivotally supported on a rack, one end of the swinging plate facing downward toward a slot of the base board and the other end of the swinging plate being a stopper end, whereby when the toy is lifted, the swinging plate rotates about the pivot shaft and the stopper end thereof moves upward to stop the eccentrical rod.

* * * * *